US005529276A

United States Patent [19]

Szablya

[11] Patent Number: 5,529,276

[45] Date of Patent: Jun. 25, 1996

[54] FRANGIBLE GUY ATTACHMENT FOR UTILITY POLES

[75] Inventor: Louis Szablya, Spokane, Wash.

[73] Assignee: Breakaway Products, Inc., Spokane, Wash.

[21] Appl. No.: 80,953

[22] Filed: Jun. 21, 1993

[51] Int. Cl.[6] ..... E04H 12/02

[52] U.S. Cl. ..... 248/548; 52/98; 52/148; 248/500; 248/900

[58] Field of Search ..... 248/548, 499, 248/500, 508, 900; 403/79; 52/98–100, 148, 146

[56] References Cited

U.S. PATENT DOCUMENTS

| | | | |
|---|---|---|---|
| 2,420,267 | 5/1947 | Sefried, II | 403/79 X |
| 3,504,460 | 4/1970 | Solberg | 52/98 |
| 3,866,367 | 2/1975 | Strizki | 52/98 |
| 4,079,556 | 3/1978 | Luck et al. | 52/148 X |
| 4,528,786 | 7/1985 | Dinitz et al. | 52/98 |
| 4,858,876 | 8/1989 | Moreno | 248/548 X |

OTHER PUBLICATIONS

"Roadside Design Guide,"—American Association of State Highway Transportation Officials (1989), pp. 4–13 and 4–14.

"Safer Timber Utility Poles—vol. 1", by Ivey and Morgan—The Texas Transportation Institute, Safety Division (Sep. 1985), pp. 76–83 and 128–130.

"Roadside Safety and the Breakaway Utility Pole" by Carney, The External Relations Subcommittee of the Transmission & Distribution Committee, Edison Electric Institute (Oct. 19, 1988), pp. 1–21.

*Primary Examiner*—Alvin C. Chin-Shue
*Assistant Examiner*—Derek J. Berger
*Attorney, Agent, or Firm*—Wells, St. John, Roberts, Gregory & Matkin

[57] ABSTRACT

A frangible guy attachment adapted to be connected between a cable guy and a stationary guy anchor includes first and second elongated coaxial rods. The rods can either be formed as separate elements or can be formed integrally. In both cases the rods are constructed of an elongated rigid structural material. An intermediate coupler is coaxially fixed between the rods. The rigidity of the coupler exceeds that of the rods to concentrate shock bending stresses at an axial transition between one rod and the more rigid coupler. This stress concentration will cause the rod to fracture and break as a result of the sudden impact. A special clevis interconnects the lower end of the lower elongated rod and a conventional guy anchor, preventing subsequent attachment of additional cable guys to the anchor.

21 Claims, 4 Drawing Sheets

FRANGIBLE GUY ATTACHMENT FOR UTILITY POLES

TECHNICAL FIELD

This disclosure pertains to a frangible guy attachment for a utility pole. It is designed for usage between the lower end of a cable guy leading to a supported utility pole and a stationary ground anchor spaced outwardly from the base of the pole. The frangible guy attachment fractures and breaks when struck by a moving vehicle.

BACKGROUND OF THE INVENTION

Conventional guy cables have proven to be a structurally sound and economical solution to the need for balancing asymmetrical forces on overhead service poles used by utilities. Unfortunately, there are often situations along roadways where it is difficult, if not impossible, to avoid placing guys in designated clear zones adjacent to the roadway proper. Unless the guy is capable of breaking in response to vehicle impact, it is then required that the utility poles be set back in order that the guys can be properly positioned outside the clear zone. Placement of the guy anchor outside the clear zone can substantially increase the cost of acquiring the necessary rights of way.

A typical cable guy will not yield when struck by a vehicle moving at moderate speeds. The pole itself will normally fail before the guy. Because one end of a cable guy is firmly fixed to a ground anchor and its other end is attached to the upper section of a supported pole, the pole will be either pulled directly toward the vehicle or the tensioned cable guy will slice through the vehicle. This creates a serious potential for injury to the vehicle's occupants.

To assist in preventing the damage and injury caused by standard down guys, efforts have been made to develop a down guy attachment that can be effectively used in designated clear zones. Earlier efforts preceding the development of this invention used a length of galvanized pipe as a transition between the standard guy cable anchor and a guy cable. It was anticipated that the root of the thread at the junction on an upper clevis on the pipe would provide an adequate stress riser to initiate fracture of the pipe. While successful initial tests of the frangible link were reported publicly in 1985 and 1989, I later found that these results could not be consistently duplicated. The present invention is an offshoot of such research efforts. It has proven to yield consistent results satisfactory to industry needs.

BRIEF DESCRIPTION OF THE DRAWINGS

Preferred embodiments of the invention are described below with reference to the accompanying drawings, which are briefly described below.

FIG. 12 is an enlarged fragmentary view of the lower end of an installed frangible guy attachment.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 5:
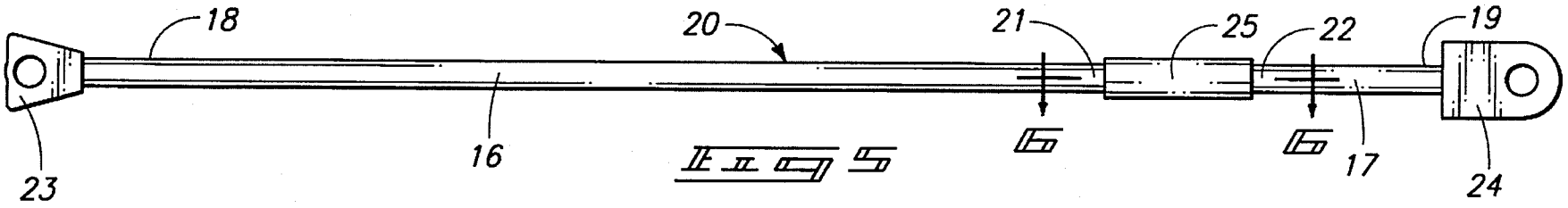
FIG. 5 is an elevation view of a first embodiment of the guy attachment.
Figure 6:
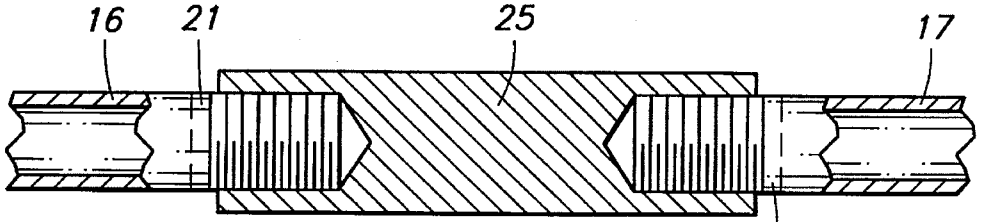
FIG. 6 is an enlarged fragmentary cross-sectional view as seen along line 6—6 in FIG. 5.
Figure 7:
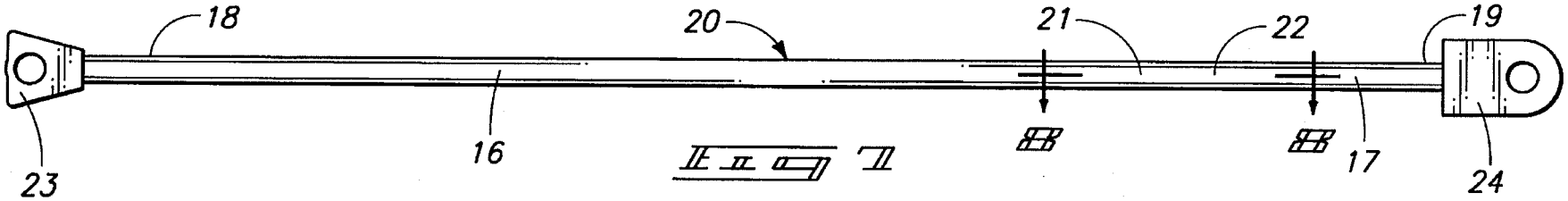
FIG. 7 is an elevation view of a second embodiment of the guy attachment.
Figure 8:
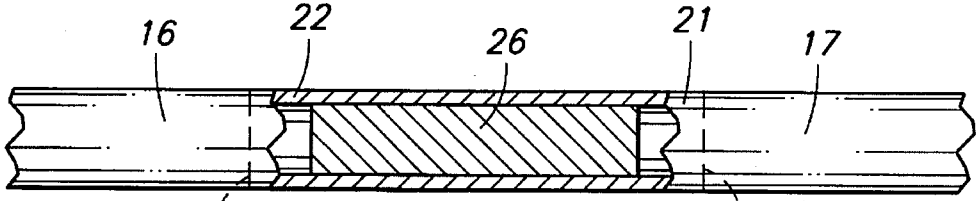
FIG. 8 is an enlarged fragmentary cross-sectional view as seen along line 8—8 in FIG. 7.
Figure 9:
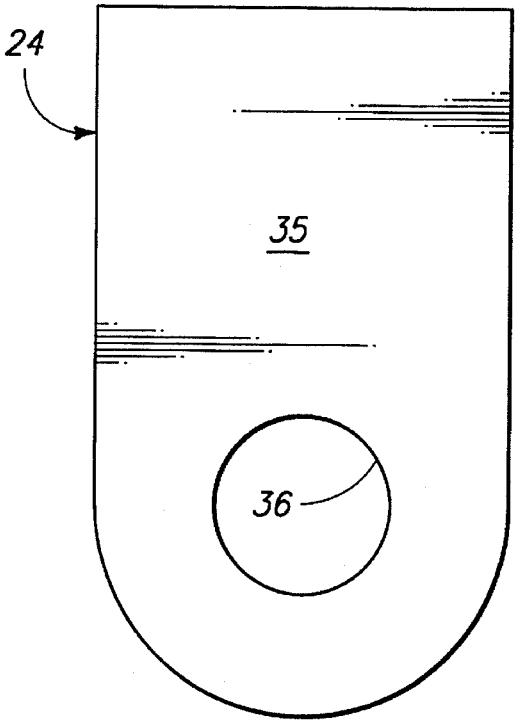
FIG. 9 is an enlarged side view of a clevis.
Figure 10:
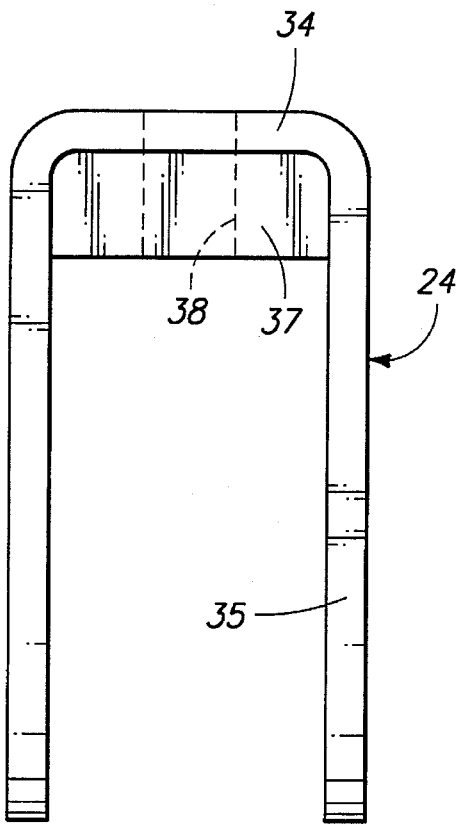
FIG. 10 is an end view.
Figure 11:
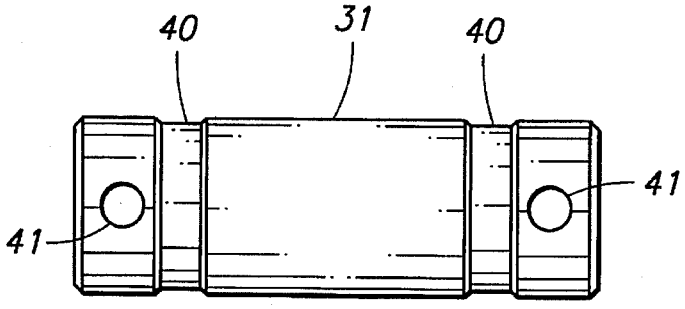
FIG. 11 is a side view of a locking pin.
Figure 11:
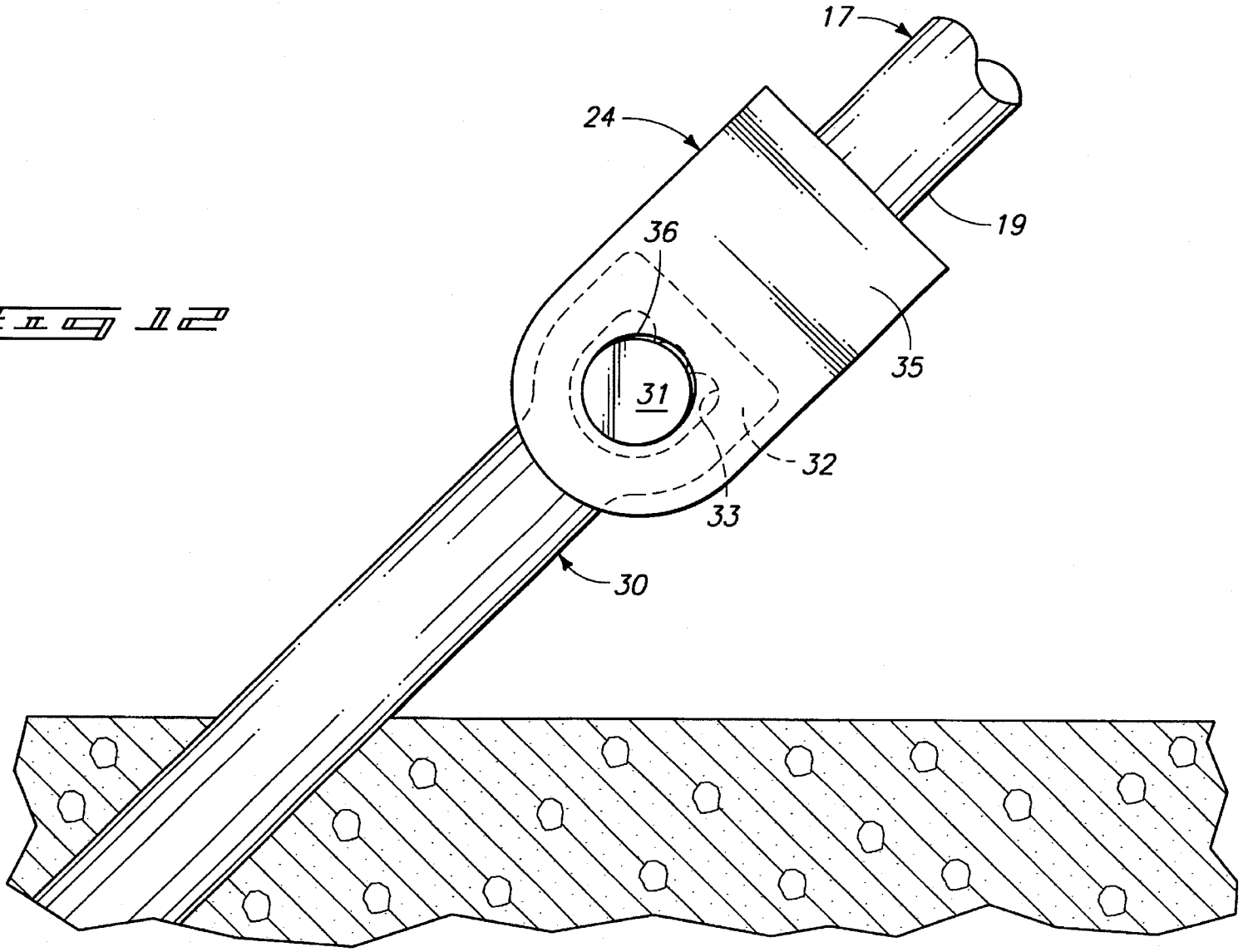

FIGS. 1–4 generally illustrate typical applications of the frangible guy attachment for support of utility poles along a roadway right of way. FIGS. 5 and 6 show details of an external coupler form of the invention. FIGS. 7 and 8 show details of an internal coupler form. Because most of the elements shown in FIGS. 5–8 are common to both embodiments, identical reference numerals are used with respect to these common features.

FIGS. 9–12 illustrate details of a clevis and locking pin designed specifically for use as part of the frangible guy attachment.

The present frangible guy attachment is designed to break upon front impact by a vehicle (passenger automobile or light truck) travelling at a moderate forward speed. It can be used in those applications where the removal of a guy will not cause the supported utility pole or adjacent poles to fail. It provides a frangible link in a flexible guy and has sufficient tensile strength to terminate the required down guy.

In the case of a typical cable guy, stress is created when the guy is struck by a moving vehicle, but the stress is then absorbed in the flexible bending ability of the cable. The cable will remain intact unless the impact results in breakage of the cable or its anchors. It might slice through the moving vehicle or cause the pole to fracture and fall upon the vehicle. The present guy attachment is designed to fracture and break when struck by a moving vehicle, thereby relieving stress created in the guy by the vehicle impact.

Two typical installations of the present frangible guy attachment are illustrated in FIGS. 1–4.

Figure 1:
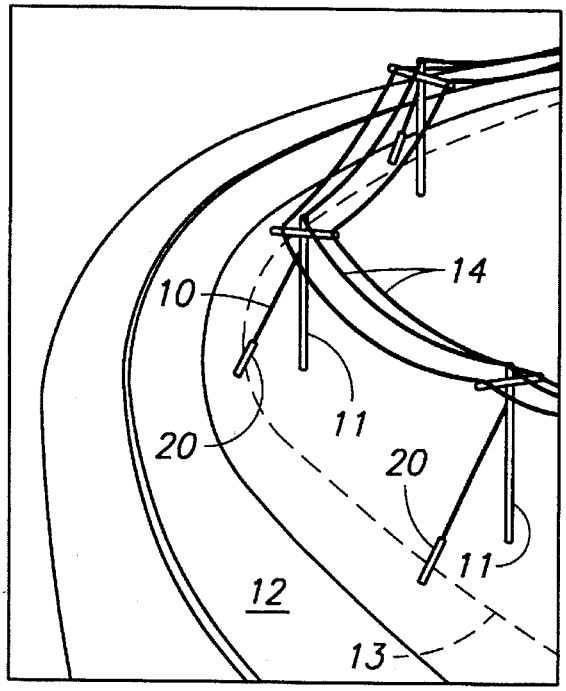
FIG. 1 is a diagrammatic view illustrating an application of the frangible guy attachments to assist in supporting a group of utility poles located along the inside of a roadway corner.
Figure 2:
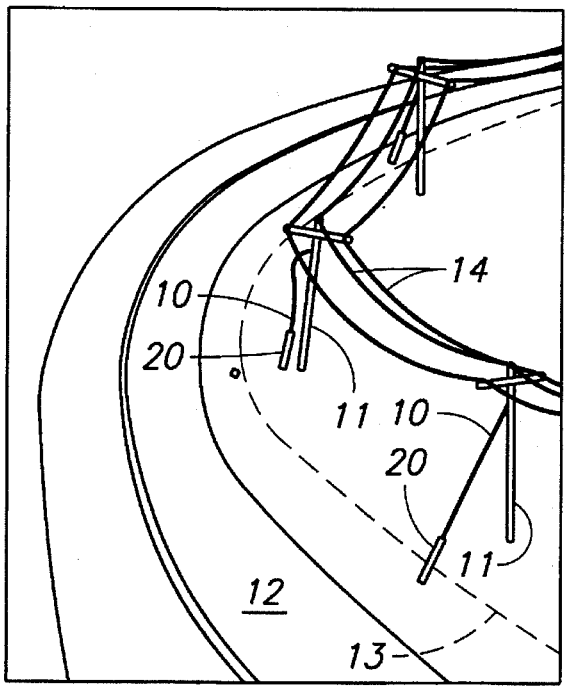
FIG. 2 is a view similar to FIG. 1, illustrating the same utility poles after one guy attachment has been broken.

FIGS. 1 and 2 show an application where overhead utility wires 14 are located along the inside of a corner adjacent to a roadway 12. The utility poles 11, which are typically constructed of wood, are located just outside a designated clear zone, whose boundary is illustrated by dashed line 13. The diagonal supporting cable guys 10 are interconnected to a conventional stationary ground anchor by means of the present guy attachments 20. The down guys, composed of the cable guys 10 and the frangible guy attachments 20, counteract the unbalanced load on the poles 11 exerted by the inside corner configuration along the overhead wires 14. The present frangible guy attachments 20 permit the poles 11 to be placed closer to the clear zone, thereby avoiding additional right-of-way acquisition expense.

When a moving vehicle strikes and breaks a frangible guy attachment (as shown in FIG. 2), the affected pole 11 will lose the support of the down guy. However, the pole 11 will remain standing without this support because it has sufficient strength and ground resistance to temporarily withstand the unbalanced load until the situation can be repaired.

When a broken frangible guy attachment 20 leaves a utility pole 11 unreinforced, it must then carry the unbalanced overhead load by itself. Prudent design might require strengthening the utility pole and adjacent poles, reducing the dead-end load on the pole, and/or using frangible guy attachments on adjacent poles. Utility poles provided with the frangible guy attachments must in all cases be capable of self support on a temporary basis after breakage of the guy attachment 20 associated with them.

Figure 3:
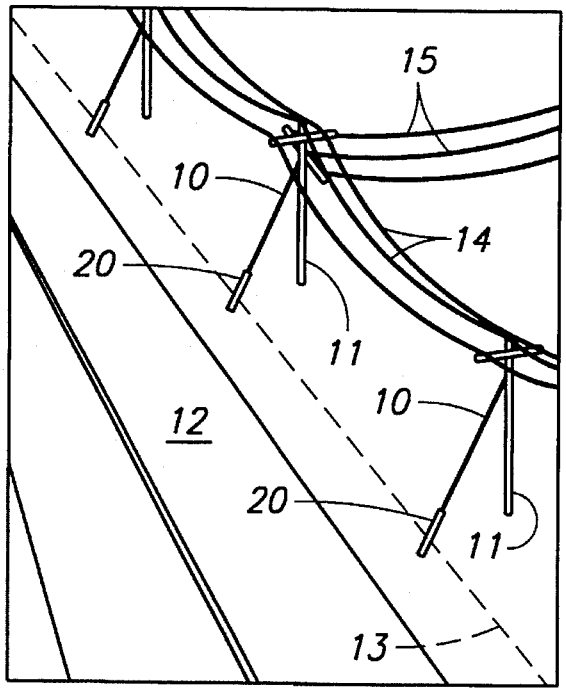
FIG. 3 is a diagrammatic view illustrating use of the guy attachments to assist in supporting a group of utility poles located adjacent to a lateral tap.
Figure 4:
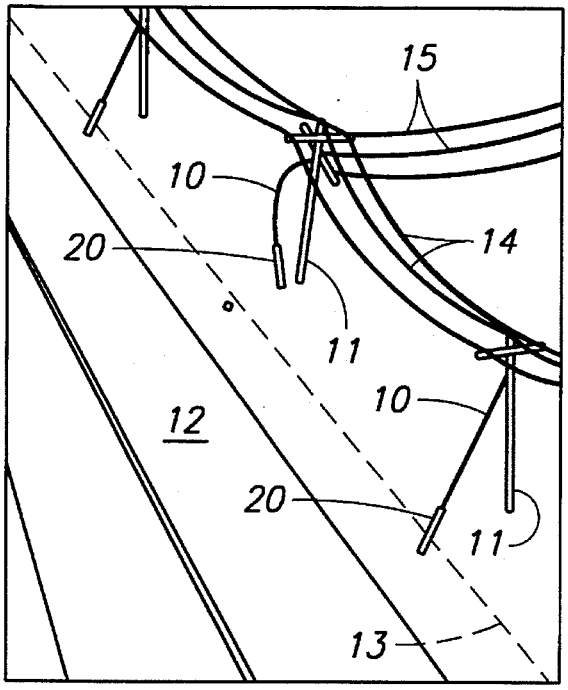
FIG. 4 is a view similar to FIG. 3, illustrating the same utility poles after one guy attachment has been broken.

FIGS. 3 and 4 illustrate application of the guy attachment 20 to a lateral tap 15. The same reference numerals are used in FIGS. 3 and 4 as were discussed with respect to FIGS. 1 and 2, with the addition of the illustrated lateral tap 15 leading to the centrally illustrated utility pole 11.

A lateral tap is utilized where a service drop or primary line is tapped from a feeder line so that the tap runs perpendicularly to it. Lateral taps constitute a very common configuration in the overhead utility industry. In such applications, the transverse tension forces exerted on the pole due to the lateral tap must be counteracted by a down guy to keep the supporting utility pole stable. The cost of acquiring the necessary rights of way to allow for placement of conventional guy anchors outside the clear zone along the side of the roadway makes the present frangible guy attachment an excellent solution to the support requirements for the utility poles adjacent to lateral tap 15.

The structure of the frangible guy attachment can best be understood from FIGS. 5 and 6. In general, it includes first and second elongated rods 16 and 17. They are made of a substantially rigid material, preferably metal pipe. The rods 16 and 17 are coaxially aligned along their centers. They have respective outer ends 18, 19 and inner ends 21, 22 spaced along a straight axis through their cross-sectional centers. An intermediate coupler 25 is coaxially fixed between the two rods 16, 17. The elongated rods 16, 17 extend outwardly from the coupler 25 in opposite axial directions.

First attachment means is provided at the outer end 18 of the first rod 16 for securing the rod 16 to the lower end of a cable guy 10. This first attachment means is illustrated as an eye 23. A normal guy termination (not shown) can be attached to the eye 23 in a conventional manner.

In the illustrated embodiment, the eye 23 is configured in a manner similar to a conventional single eye anchor used for a stationary guy anchor at the lower end of a cable or wire guy. It is threadably fixed to the outer end 18 of the rod 16, but could be attached by welding or any other suitable fastening arrangement capable of securing it in place and absorbing the required tensile loading on the guy attachment.

The second attachment means at the opposite end of the guy attachment 20 constitutes a clevis 24. A preferred form of the clevis is detailed in FIGS. 9–12.

Clevis 24 basically comprises a U-shaped bracket having a top transverse member 34 and a pair of transversely spaced side plates 35 capable of straddling an upright eye 32 at the top end of a stationary guy anchor 30. Clevis 24 is also threadably fixed to the guy attachment 20. It includes transverse apertures designed to receive a locking pin 31 which extends through the clevis 24 and an interposed eye 32 to transversely join them to one another.

The eye 32 of the guy anchor 30 can be designed for attachment to a single cable or one designed to support multiple cables (as shown in FIG. 12). The side plates of clevis 24 should be sufficiently wide to overlap the cable opening 33 of eye 32. It will then prevent attachment of additional guy cables or wires to the opening within the eye of a connected guy anchor 30. By overlapping the access normally available in such openings for additional guy cables or wires, the clevis 24 assures that no additional flexible guys can be used between the guy anchor and the cable guy connected to the frangible guy attachment, which would defeat the purpose of the present invention.

The rigidity of the intermediate coupler 25 must differ from the rigidity of the rods 16, 17. In a preferred form of the invention, the intermediate coupler has substantially greater rigidity or stiffness than the rods 16, 17. This means that the resistance to bending along the length of the coupler 25 is greater than the corresponding resistance to bending along a similar length of the rods 16, 17. The coupler rigidity can be enhanced by selection of materials and by its cross-sectional configuration relative to the cross-sectional configuration of rods 16, 17. It also must be designed so as to not collapse transversely or bend longitudinally in response to imposition of the expected impact forces to which it will be subjected.

The relative lengths of the first and second rods 16, 17 differ from one another. Their respective lengths should be selected to position the coupler 25 in an elevation at or adjacent to the intended zone of impact of the guy attachment 20 when installed to one side of a utility pole at a normal installation angle. Coupler 25 can either be centered within this zone or can be positioned directly above or below this zone when guy attachment 20 is arranged at its conventional angular position aligned with the cable guy 10 and guy anchor 30 attached to it, as shown in FIGS. 1–4 and 12. This dimensional relationship is dictated by the relatively standard height of front bumpers on passenger vehicles and utility trucks.

The theory of operation of the guy attachment is that the sudden impact forces imparted to the guy attachment 20 by a forwardly moving vehicle will produce shock bending loads and stresses in the area of impact. These shock loads will be concentrated at an axial transition between one of the elongated rods 16, 17 and the more rigid intermediate coupler 25 due to its greater resistance to bending. The resulting concentration of stress will then cause the one rod to fracture and break.

If the coupler 25 is centered elevationally across the actual zone of impact, breakage might occur in either rod 16 or 17 at the transition between the rod and coupler. If the coupler is slightly above the zone of impact, the forces exerted on the lower rod 17 will cause it to break adjacent to the lower end of coupler 25. Conversely, if the zone of impact is upwardly adjacent to the coupler 25, the forces imparted to the bottom end of rod 16 will cause it to break at its transition relative to the upper end of the more rigid coupler 25.

In the illustrated embodiment of FIGS. 5 and 6, intermediate coupler 25 is formed as a solid block threadably connected to the opposed second ends 21, 22 of the elongated rods 16, 17, respectively. The elongated rods 16, 17 are shown as being cylindrical and have a common exterior diameter. They can be formed as separate lengths of structural metal rigidly joined to opposite axial ends of coupler 25. The rods 16 and 17 can be either hollow or solid.

Both the rods 16 and 17 plus the coupler 25 are shown in the drawings as fabricated from metal pipe. They have cylindrical outer shapes of common cross-sectional dimensions along their respective lengths. This is advantageous because a cylindrical member has a maximum moment of inertia for a given surface area, when compared with other cross-sectional configurations. While the rods 16, 17 preferably have such cylindrical outer surfaces, it is to be understood that other cross-sectional configurations can be used when this is found to be desirable.

In one specific configuration of the guy attachment designed for applications where the working load limit of the down guy does not exceed 10,200 pounds, the rods 16, 17 have been produced from ¾ inch ASTM A106B steel pipe. The upper rod 16 has a length of 52 inches and is threaded at both ends. The lower rod 17 has a length of 8 inches and is also threaded at both ends.

The solid metal coupler 25 has been formed from 1¼ inch cylindrical stock of ASTM 1018 steel drilled and threaded coaxially at its opposite ends to complement the threads at the ends of rods 16, 17. The length of coupler 25 is approximately 5½ inches.

The components illustrated in FIGS. 5 and 6 are preferably assembled by torquing the threaded connections at the respective ends of the rods 16, 17. Torquing the joints prestresses the axial transitions between coupler 25 and rods 16, 17 and increases the axial tensile strength of the resulting assembly without substantially increasing shear forces within the threaded joints. This also appears to assist in concentrating impact stresses at the roots of the threads at these axial transitions and apparently facilitates fracturing and breaking of the rods 16, 17 across the threads upon impact.

The assembled guy attachment can be galvanized as a unit for rust protection purposes. It is then connected between a stationary ground anchor and an angular wire or cable guy in supporting configurations common to the utility industries. The ability of the guy attachment 20 to break when impacted by a vehicle not only reduces right of way expenses to the utility, but substantially reduces the probability of injury to the passengers of the vehicle.

The guy attachment produced by use of the listed materials has a recommended load limit of 12,200 pounds. Its approximate yield strength is 12,800 pounds and its approximate ultimate strength is 14,800 pounds. A typical utility guy wire of ⅜ inch diameter has ultimate tensile strength of approximately 11,500 pounds, while a 7/16th inch utility guy wire has an ultimate tensile strength of approximately 18,000 pounds. The overall length of the guy attachment 20 is 6 feet. Its weight is 15 pounds. It is well suited for applications which use ⅜ inch down guys. It has been designed to meet current requirements for "break away" devices as developed by the American Association of State Highway and Transportation Officials and the Transportation Research Board of the National Research Council. It is not designed to break in response to impact of other users of roadways, such as motorcycles, pedestrians or horses. No special tools are required to install the guy attachment other than those conventionally utilized in the installation of down guys.

The guy attachment 20 has been designed to normally accept only one down guy per attachment to a stationary ground anchor. However, two or more guys can extend upwardly from a single guy attachment where such bracing of a pole is desired.

Where two guy attachments and guy anchors are needed in a particular application, the use of a second guy attachment is practical if its guy anchor is placed an adequate distance away from the first one to assure that a vehicle can only impact guy attachment at a time. This requirement dictates that the minimum distance between the two down guy anchors associated with a utility pole must be the same as the expected swath or width of a vehicle that might leave the adjacent roadway. This will prevent a vehicle from striking more than one guy attachment simultaneously and allow for proper breaking action of either or both impacted guy attachments.

The second embodiment of the invention, which is illustrated in FIGS. 7 and 8, utilizes an internal coupler 27. In this form of the invention, the first and second rods 16, 17 are formed integrally with one another from tubular metal stock.

Coupler 27 can be in the form of a cylindrical solid plug whose outer cross-sectional configuration complements the inner cross-sectional configuration of the integral rods 16, 17 that extend outwardly from it. Coupler 27 must be axially fixed within the surrounding tubular rod structure. This can be accomplished by welding or by mechanically crimping the tubular structure about the coupler. Other securing arrangements, including fasteners and adhesives, might be utilized where desired.

The axial dimensional sizes and relationships of the elements in this configuration of the guy attachment are substantially identical to those previously described with respect to FIGS. 5 and 6.

When impacted, the bending forces between the more rigid coupler 27 and the connected rods 16, 17 will be concentrated at the axial transitions between one of the rods and the coupler, again causing the rod to fracture and break as a result of the sudden impact.

While not always essential, score lines 26 can be cut about the periphery of the rods 16, 17 at locations axially adjacent to the couplers 25 or 27. Exemplary locations for the score lines 26 are shown by dashed lines in FIGS. 6 and 8, respectively. Score lines can also be used in the first embodiment of the invention when desired. As is well known, the score lines provide an area of mechanical weakness about the rods and further concentrate bending stresses to facilitate breakage of the rods upon sudden impact.

FIGS. 9–12 illustrate details of a preferred form of clevis 32 and complementary pin 31. The U-shaped clevis 32 includes two identical side plates 35 that are transversely spaced and parallel to one another. They include aligned transverse apertures 36 adjacent their lower or outer ends. The transverse connecting member 34 at the top of clevis 24 is reinforced by a welded block 37 including a threaded aperture 38, which also extends through the top transverse member 34. The threaded aperture 38 is complementary to the threaded end 19 of the lower elongated rod 17, which is threadably fitted within it.

The width across each plate 35 at the sides of its aperture 36 is such as to substantially cover the opening 33 of the eye 32 of which it is to be used. This is particularly important when using the frangible guy attachment in conjunction with a ground anchor 30 having a multiple cable eye, as illustrated in FIG. 12. By overlapping all or most of the opening 33, the straddling plates 35 of clevis 24 provide a physical barrier to subsequent use of the eye 32 for additional cable attachments to the supported pole.

Pin 31 is formed as a metal cylinder having an outer diameter slightly less than the inner diameter of apertures 36 in clevis 24. The outside of pin 31 is also provided with two axially spaced grooves 40. The width of each groove is substantially identical to the thickness of each plate 35 on clevis 24. The spacing between grooves 40 is identical to the spacing between the side plates 35. Thus, when pin 31 is centered through clevis 24 and received within the apertures 36 and opening 33 of an interconnected eye 32, the resulting tension exerted on the clevis 24 will cause the side plates 35 to mechanically interlock within the receiving grooves 40. This interlock will assist in retaining clevis 24 in place and prevent unwanted tampering with the cable guy arrangement. The outer ends of pin 31 are provided with radial holes 41 for reception of locking cotters or other pins (not shown), which would be located to each side of clevis 24 in the completed assembly.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A frangible guy attachment adapted to be secured between a cable guy and a stationary guy anchor for holding a utility pole in an upright position to balance asymmetrical forces on the pole, comprising:

first and second hollow, tubular elongated rods along an axis, each rod having spaced inner and outer ends;

an intermediate coupler fixed between the inner ends of the first and second elongated rods with the respective rods extending outwardly in opposite directions from the intermediate coupler; the intermediate coupler having a substantially greater rigidity than that of the first and second elongated rods;

first attachment means at the outer end of the first elongated rod for securing it to a cable guy; and second attachment means at the outer end of the second elongated rod for securing it to a ground anchor;

the relative lengths of the first and second elongated rods being selected to position the intermediate coupler in an axial position at or adjacent to an intended zone of impact of the frangible guy attachment when installed to one side of a utility pole;

whereby sudden impact of the frangible guy attachment by a moving vehicle will concentrate shock bending stresses at an axial transition between one of the elongated rods and the more rigid intermediate coupler and thereby cause the one elongated rod to fracture and break.

2. The frangible guy attachment of claim 1, wherein the axial length of the intermediate coupler is substantially less than the combined lengths of the first and second elongated rods.

3. The frangible guy attachment of claim 1, wherein the length of the first elongated rod is substantially different from the length of the second elongated rod.

4. The frangible guy attachment of claim 1, wherein the first and second elongated rods are separate lengths of structural metal rigidly joined to opposite axial ends of the intermediate coupler.

5. The frangible guy attachment of claim 1, wherein the intermediate coupler comprises a solid cylindrical block of metal.

6. The frangible guy attachment of claim 1, wherein the first and second elongated rods include cylindrical interior surfaces of a common diameter;

the intermediate coupler comprising a solid cylindrical block of metal having an outer surface of a diameter complementary to the common diameter of the cylindrical interior surfaces of the first and second elongated rods, the intermediate coupler being fixed within the interior surfaces of the first and second elongated rods.

7. The frangible guy attachment of claim 1, wherein the intermediate coupler comprises a solid cylindrical block of metal fixed to the inner ends of the respective elongated rods.

8. The frangible guy attachment of claim 1, wherein the first and second elongated rods are separate lengths of metal pipe each having its inner end threadably connected to opposite axial ends of the intermediate coupler.

9. The frangible guy attachment of claim 1, wherein the first and second elongated rods are formed from separate lengths of metal pipe, each elongated rod including threads formed about its inner end;

the intermediate coupler comprising a sleeve formed as a cylindrical block of metal including threaded coaxial recesses at opposite ends thereof that are complementary to the threaded inner ends of the respective elongated rods.

10. The frangible guy attachment of claim 1, wherein the first and second elongated rods are formed from separate lengths of metal pipe having a common outer diameter, each elongated rod including external threads formed about its inner end;

the intermediate coupler comprising a solid cylindrical block of metal including internally threaded coaxial recesses at opposite ends thereof that are complementary to the threaded inner ends of the respective elongated rods.

11. The frangible guy attachment of claim 1, wherein the first and second elongated rods are formed from hollow metal pipe having a common outer diameter, each elongated rod including external threads formed about its inner end;

the intermediate coupler comprising a solid cylindrical block of metal having a constant outer diameter that is greater than the common outer diameter of the first and second elongated rods, the intermediate coupler including coaxial internally threaded coaxial recesses formed at opposite ends thereof, the threaded coaxial recesses of the intermediate coupler being complementary to the threaded inner ends of the respective elongated rods.

12. The frangible guy attachment of claim 1, wherein the first and second elongated rods are tubular and integrally formed from a single length of structural metal having the intermediate coupler fixed within it at a location spaced from the outer ends of the respective elongated rods.

13. The frangible guy attachment of claim 1, wherein the first and second elongated rods are tubular and integrally formed from a length of structural metal having a constant inner diameter, the intermediate coupler being welded within the length of structural metal at a location spaced from the outer ends of the respective elongated rods;

the intermediate coupler comprising a solid cylindrical length of metal having an outer diameter complementary to the inner diameter of the length of structural metal.

14. The frangible guy attachment of claim 1, further comprising:

at least one scored line formed about the exterior of the elongated rods at an axial location outwardly adjacent to the intermediate coupler.

15. The frangible guy attachment of claim 1, wherein the second attachment means comprises:

a U-shaped bracket having a pair of transversely spaced side plates that are apertured and capable of straddling the top end of a stationary guy anchor;

the U-shaped bracket including a top transverse member spanning the pair of apertured side plates;

each side plate of the U-shaped bracket having sufficient width to substantially overlap the width of a transverse eye formed through the guy anchor to prevent attachment of additional guy cables to the guy anchor.

16. The frangible guy attachment of claim 1, wherein the second attachment means comprises:

a U-shaped bracket having a pair of transversely spaced side plates that are apertured and capable of straddling the top end of a stationary guy anchor;

the U-shaped bracket including a top transverse member spanning the pair of apertured side plates;

each side plate of the U-shaped bracket having sufficient width to substantially overlap the width of a transverse eye formed through the guy anchor to prevent attachment of additional guy cables to the guy anchor; and a locking pin removably secured between the apertured side plates.

17. The frangible guy attachment of claim 1, wherein the second attachment means comprises:

a U-shaped bracket having a pair of transversely spaced side plates that are apertured and capable of straddling the top end of a stationary guy anchor;

the U-shaped bracket including a top transverse member spanning the pair of apertured side plates;

each side plate of the U-shaped bracket having sufficient width to substantially overlap the width of a transverse eye formed through the guy anchor to prevent attachment of additional guy cables to the guy anchor; and a locking pin removably secured between the apertured side plates, the pin being formed as a cylinder having a pair of annular grooves formed about its outer surface at spaced locations corresponding to the spacing of the apertured side plates.

18. A utility pole guy anchor and clevis, comprising:

a guy anchor having a transverse eye of prescribed size for receiving a utility pole guy cable;

a U-shaped bracket means having a pair of transversely spaced side plates that are apertured for straddling the top end of the stationary guy anchor;

the U-shaped bracket including a top transverse member spanning the pair of apertured side plates; and means on each side plate of the U-shaped bracket for preventing attachment of additional guy cables to the guy anchor.

19. The utility pole guy anchor and clevis of claim 18, further comprising:

a locking pin removably secured between the apertured side plates.

20. The utility pole guy anchor and clevis of claim 18, further comprising:

a locking pin removably secured between the apertured side plates, the pin being formed as a cylinder having a pair of annular grooves formed about its outer surface at spaced locations corresponding to the spacing of the apertured side plates.

21. The utility pole guy anchor and clevis of claim 18, further comprising:

attachment means on the top transverse member for fixing it to the lower end of a frangible guy attachment.

* * * * *